United States Patent [19]

Nordstrom

[11] Patent Number: 5,057,834

[45] Date of Patent: Oct. 15, 1991

[54] METHOD AND DEVICE FOR MONITORING THE STEERING PERFORMANCE OF VEHICLE OPERATOR

[75] Inventor: Knut L. Nordstrom, Linkoping, Sweden

[73] Assignee: Saab-Scania Aktiebolag, Linkoping, Sweden

[21] Appl. No.: 429,586

[22] Filed: Oct. 31, 1989 (Under 37 CFR 1.47)

[30] Foreign Application Priority Data

Mar. 10, 1988 [SE] Sweden ..... 8800848
Mar. 9, 1989 [SE] Sweden ..... PCT SE89/00113

[51] Int. Cl.[5] ..... G08B 23/00

[52] U.S. Cl. ..... 340/963; 180/272; 244/76 R; 340/945; 340/576

[58] Field of Search ..... 340/963, 945, 965, 971, 340/425.5, 439, 465, 575, 576; 180/272; 244/1 R, 175, 184, 192, 194, 76 R; 364/424.06, 424.01

[56] References Cited

U.S. PATENT DOCUMENTS 3,654,599 4/1972 Sepper .
3,980,999 9/1976 Nishioka et al. ..... 180/272
4,604,611 8/1986 Seko et al. ..... 180/272
4,775,116 10/1988 Klein ..... 340/945

FOREIGN PATENT DOCUMENTS 0119484 9/1984 European Pat. Off. .

*Primary Examiner*—Donnie L. Crosland
*Assistant Examiner*—Brent A. Swarthout
*Attorney, Agent, or Firm*—Lowe, Price, LeBlanc & Becker

[57] ABSTRACT

A method and device for monitoring the consciousness of an aircraft pilot or operator of any other vehicle are described. The monitoring comprises the control of the steering deflections effected by the operator, the size and direction of which are indicated by a steering signal (DP) emitted from the steering control. For every new steering control deflection effected in the opposite direction to the one immediately preceding the time value (CPT) for the steering control deflection is calculated and this time value is compared with at least one predetermined time limit value (CPTW, CPTA). At an excessive signal amplitude considered to indicate an abnormal steering performance which may be caused by a lowered degree of consciousness a warning signal and/or an auto-steering mode is activated. The monitoring according to the invention may also cover abnormally large and rapid steering control deflections as conditions for the activation of the warning signal and the auto-steering mode.

20 Claims, 4 Drawing Sheets

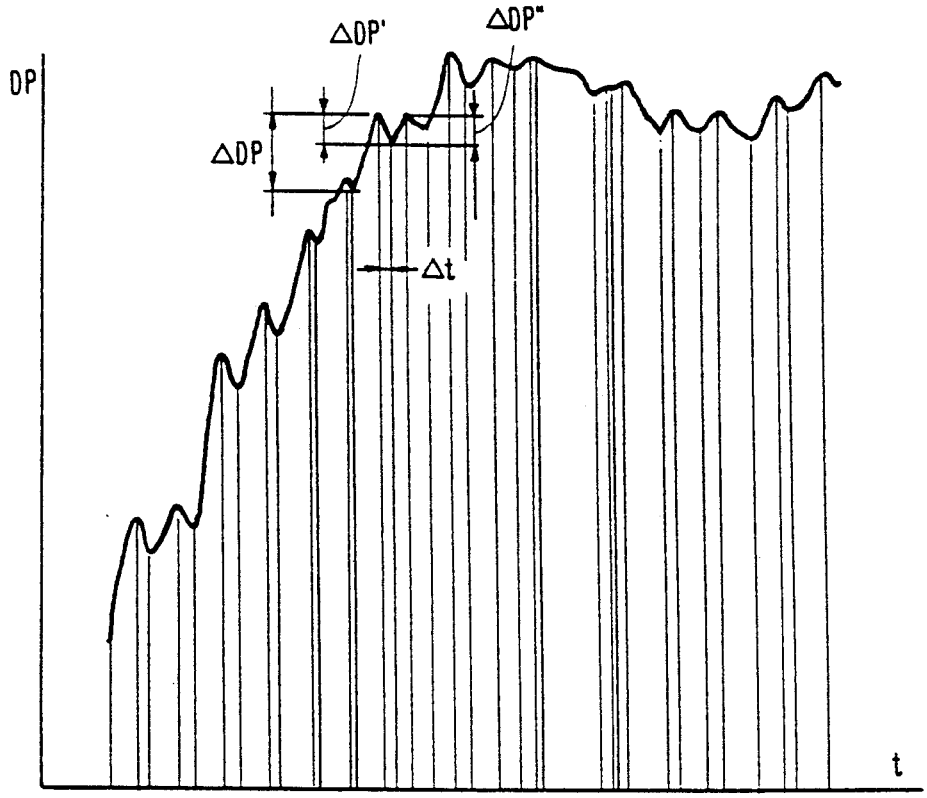
Fig 2
Fig 3A
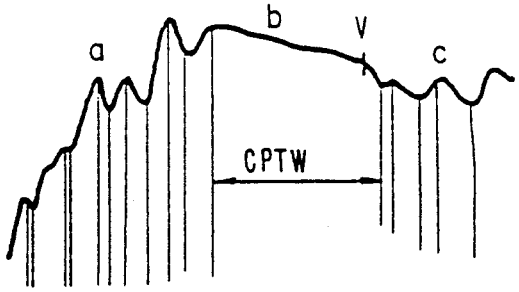
Fig 3B
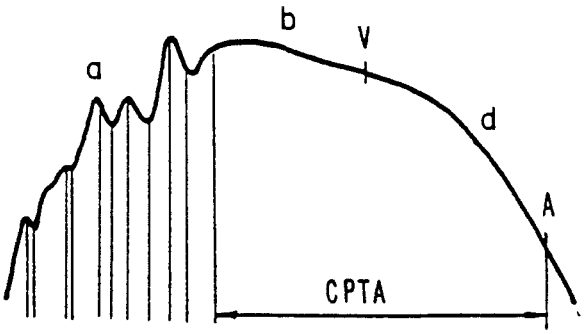

METHOD AND DEVICE FOR MONITORING THE STEERING PERFORMANCE OF VEHICLE OPERATOR

CROSS REFERENCES TO RELATED APPLICATIONS

This application is a continuation of PCT application PCT/SE89/00113, filed Mar. 9, 1989, designating the United States and other countries and claiming the priority of Swedish application 8800848-7, filed Mar. 10, 1988.

BACKGROUND OF THE INVENTION

The present invention relates to a method and device for monitoring the steering performance of the operator of a vehicle and reacting to the detection of abnormalities to activate a warning signal and/or switching to an automatic steering mode. More particularly, the invention relates to a monitoring of the steering control system of a vehicle to produce a steering signal indicating the size and direction of steering deflections, analyzing such deflections to detect an abnormal steering performance and reacting to such performance to cause activation of such warning signal and/or switching to an automatic steering mode.

The development of modern combat aircraft with increasingly high demands on performance has in recent years created a situation where the mental and physical abilities of the pilot set the limits of total capability and performance. One of the problems is the risk that in certain extreme situations the pilot will be subjected to sudden loss of consciousness caused by an extreme increase in the load factor (acceleration). This condition, which among experts is usually called G-LOC (G-induced Loss of Consciousness), is closely related to the loss of consciousness that is known to occur to a combat aircraft pilot exposed to a high, evenly growing load factor, e.g., on climbing after a dive. However there is a distinct difference. In the last-mentioned situation warning symptoms appear such as tunnel vision or a still longer effect on the pilot's vision function (so-called "gray out"). As a result the pilot remains capable of interrupting a dangerous maneuver in time. In contrast G-LOC occurs instantaneously and without any sensation to forewarn the pilot. The difference depends on the level and the amount of time in which the change in load factor occurs.

Medically, the loss of consciousness that may occur to a pilot is directly related to the level of oxygen in the brain and thereby to the heart's ability to overcome the hydrostatic pressure difference between heart and brain. During a slow G-load increase the blood flow to the brain will decrease gradually in proportion to the increase of the counter-pressure in the heart. This in turn leads to a decrease of the oxygenation in the brain to a corresponding degree; this despite the fact that the body, through vasoconstriction and increased pumping ability, endeavors to compensate for the counter-pressure increase. The vision function is affected due to the low oxygen level before the level becomes so low that loss of consciousness occurs.

If, on the contrary, the blood flow to the brain is suddenly interrupted due to a rapid G-load increase, there remains only the brain's own oxygen reserve, which will last for about 5 seconds, whereupon loss of consciousness occurs without prior symptoms. Also there is insufficient time for the body to respond to the quick oxygen change to compensate through alteration in the blood pressure.

G-LOC causes a total loss of consciousness for about 15 seconds, whereupon there is a period of continuing serious lack of oxygen for about 10 seconds. During the last part of the loss of consciousness the pilot may be subjected to rapid muscle contractions similar to those occurring during an epileptic seizure. When consciousness is regained disorientation usually follows in combination with amnesia on awakening.

The load factor at which lack of oxygen begins to appear is about 6 G subject to individual variations. There may be danger of G-LOC if the load factor increases to a total of more than 6 G during a time shorter than 5 seconds and if this high load factor is allowed to act longer than 5 seconds.

Such values can easily be obtained in the latest generation of combat aircraft and G-LOC must therefore be regarded as a very serious problem both with respect to flying safety as well as effectiveness in a combat situation. Several crashes have recently occurred abroad with newly developed aircraft and in all cases G-LOC has been stated to be the direct cause. There is a finding that 20% of certain groups of military airmen in the USA have undergone G-LOC. This information underlines further the seriousness of the situation and the need for a solution to the problem.

It is previously known to provide the pilot with means for maintaining the brain's oxygenation above a critical level through direct physical effect on his body and it has been attempted to use such means as protection also against a rapid increase of the load factor. During some ten years of study of the problem by aeromedical experts extensive experiments have been conducted to improve the so-called G-suit which has long been part of the equipment of a combat pilot. This has made the pilot less sensitive to load-factor increases but before this invention has not been capable of protecting against G-LOC. Solutions have also been sought through over-pressure respiration and with the administration of a special gas in the oxygen system but these approaches have not provided a satisfactory solution.

In a current American research program efforts have been made to provide a method and a system for indicating purely physiologically that the pilot is tending toward loss of consciousness. Here the concept is to use sensors attached to the pilot's head to measure the blink frequency of the eyes, the activity in the brain or other values that can reveal if the normal conscious state is becoming critical. The method implies that these measuring data are processed and evaluated in a computer. In addition to it being very difficult to predetermine with certainty the limit when the critical state is reached for a particular pilot, the method also entails an increase in complexity from a technical system point of view with respect to the aircraft and its serviceability.

For the purpose of obtaining a simpler type of consciousness control it has further been suggested to introduce devices that sense the force with which the pilot grips the control stick and which, incorrectly, has been thought to quickly cease in the critical situation. Closely related is the concept mentioned in the specialist press of analyzing the frequency and character of the pilot's control stick movements in order to determine through such analysis whether the movements are logically correct in the prevailing flying situation. However, to attempt in this manner to distinguish normal control stick movements from the movements that the same pilot would be expected to perform if he has lost or is beginning to lose consciousness would be very difficult. Uncertainty due to individual differences between pilots is inevitable. Further, it seems impossible to provide a warning system based on frequency analysis which would work so quickly that a critical condition of the pilot can be detected and counteracted before it is too late. As mentioned above, in the case of G-LOC it is a matter of mere seconds before loss of consciousness occurs. This permits an extremely narrow time margin for a warning system to decide whether the pilot's condition is normal or abnormal on the basis of an evaluation of steering performance.

There is a similar risk to operators of land vehicles. Here, naturally, loss of consciousness due to high acceleration or acceleration growth does not occur, but a large number of accidents do occur which cannot be explained other than by the operator having fallen asleep. The reason is presumed to be that operation has become too tiring and monotonous and no apparatus has warned the operator before consciousness is lost.

Since the steering performance of a car driver at incipient loss of consciousness would be analogous to that of the pilot, the solution sought for flying should also be capable of solving the problem of lessening the risk of this type of car accident.

Despite the fact that the seriousness of the loss of consciousness problem has been known by experts for many years, and despite large efforts to provide a solution, no satisfactory solution to the problem has been presented.

SUMMARY OF THE INVENTION

According to the present invention there is provided an apparatus and method for monitoring in a control system of a vehicle the steering performance of the operator. The system comprises a steering control which is maneuvered by the operator through steering deflections in two opposite directions. This steering action is used to produce a steering signal indicating the size and direction of the steering deflections. The method comprises an analysis of the deflections to detect an abnormal steering performance which may be caused by a lowered degree of operator consciousness. Such a condition causes the system to activate a warning signal and/or switch to an automatic steering mode wherein operator assistance is not required.

It is accordingly an object of the present invention to provide a method and device for monitoring the steering performance of a vehicle operator in order to assure that the operator is conscious. The invention is based on the assumption that this is best done in the control system of the vehicle by performing an analysis of the steering deflections that the operator effects on the steering control. The steering control is assumed to be of the type described above which operates with an electric or other quantifiable steering signal. According to the invention the analysis is effected in an existing control system without adding complex equipment.

Another object of the invention is to provide a method and a device that perform the monitoring analysis of the steering deflections so quickly that an abnormal steering performance indicating a lowered degree of the operator's consciousness will be made known to the operator before consciousness is completely lost. The invention thus aims at warning the operator at the instant when an abnormal steering performance is detected. Thus warned the operator either commences careful steering to bring him back to full consciousness or if this does not occur the control system of the vehicle is caused to take over the steering to prevent a crash.

Another important object of the invention is to accomplish such a method and device by reacting to a minimum of operator steering deflections so that the desired control is constantly "rolling" and reacting only to the latest steering deflection.

A further object of the invention is to accomplish a method and device that provide control of the degree of consciousness of the vehicle operator without using a physiologically functioning apparatus applied to the operator's body or suit.

BRIEF DESCRIPTION OF DRAWINGS

The invention is explained in further detail with reference to the accompanying drawings wherein:

FIGS. 2 and 3A and 3B show diagrammatically how the maneuvering of the control stick of the aircraft and the resulting steering signal can vary in time at normal and abnormal steering performance, respectively.

DESCRIPTION OF THE PREFERRED EMBODIMENTS

Although the present invention may be used in all types of vehicles and vessels maneuvered through electric or other quantifiable non-mechanical steering signals, the invention is described by way of example in an application for aircraft. In the application only the major signal paths and functions are described. It will be understood that those parts and part functions not necessary for the understanding of the invention are not specifically described.

Figure 1:
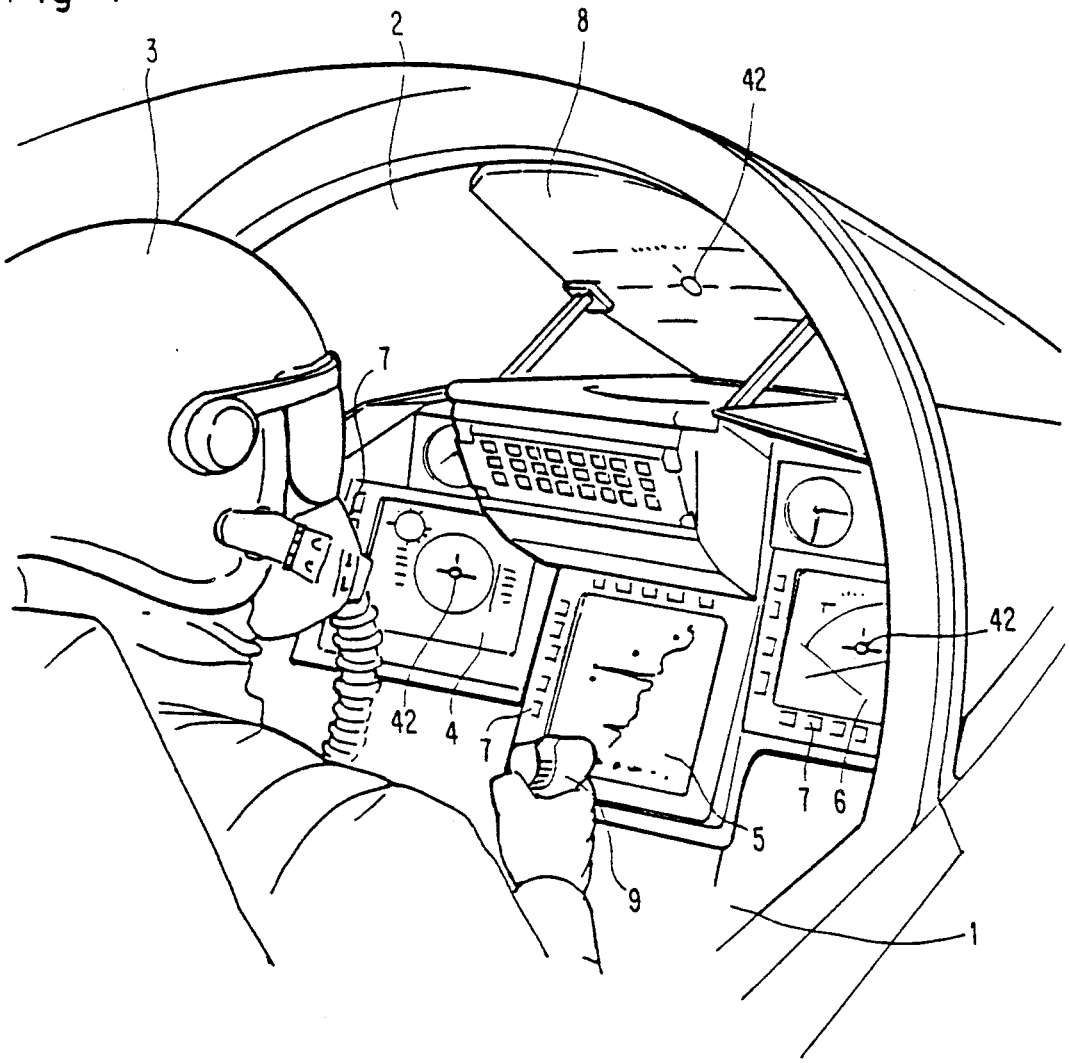
FIG. 1 is a perspective view illustrating the situation in the cockpit in an aircraft during flight.

Referring to FIG. 1, the reference numeral 1 designates a cockpit space limited in the forward direction by a cap or windshield 2 through which the pilot having helmet 3 can observe the air space or terrain in front of him. Under the windshield there are the instruments used by the pilot during flight. In modern high-performance aircraft these may comprise display units 4, 5 and 6 connected to a central computer in which all information relating to the flight is collected and processed. By actuation of the buttons 7 at each display unit the display units can present the different types of information which the pilot requests. The information may concern the current position of the aircraft in air space, data regarding a target, etc. Such information can also be presented electro-optically on a transparent screen 8 located on the inside of the windshield 2. The arrangement is well known and has the advantage that the pilot can, while controlling the aircraft with a steering control 9, obtain critical visual information without having to lower his eyes to the instruments.

Figure 4:
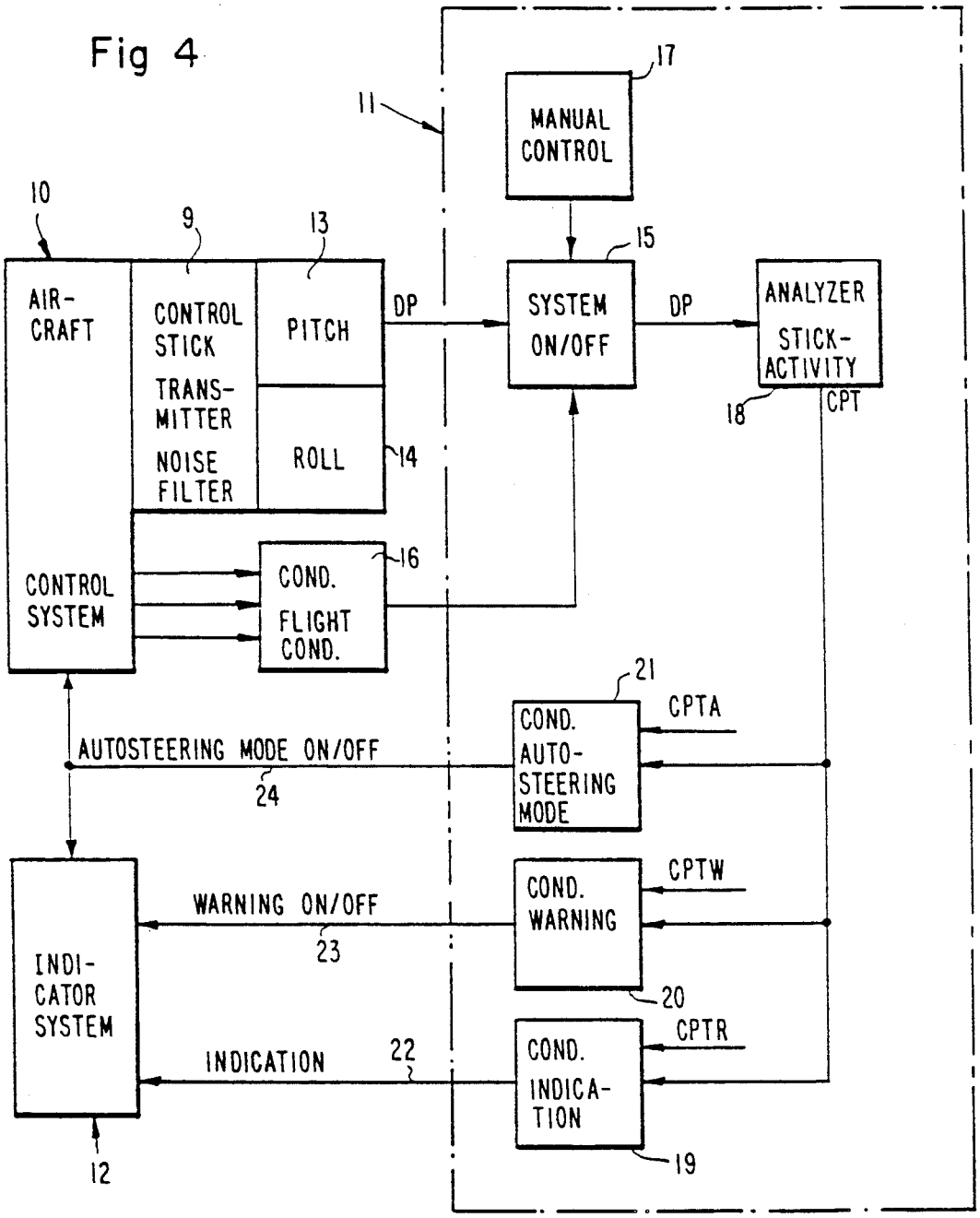
FIGS. 4 and 5 are block diagrams which show in principal the function and construction of a monitoring system according to the invention, FIG. 4 showing the monitoring system and aircraft system and FIG. 5 showing the monitoring system in further detail.

For maneuvering the aircraft according to the above presented conditions of the invention there is provided a control system 10 shown in FIG. 4. The control system operates with electric signals which are produced in a known manner by transmitters connected to the steering control 9. The signals sense the movements or steering deflections effected on the steering control by the pilot. These deflections can be referred to at least two control channels, e.g., pitch and roll, relating to movements about lateral and longitudinal aircraft axes. After signal processing which may include noise filtering, the steering signals are transferred to electro-hydraulic servos, not illustrated in FIG. 4, which produce the mechanical control surface deflections intended by the pilot.

In control systems of the type just described for which the invention is particularly well-suited, the steering control is constructed as a so-called joystick or mini-control stick, which has the technical control advantage that the pilot can act with precision, quickness and stability. Thus when steering performance is normal he makes small control stick corrections of short duration. Such steering activity is illustrated in the diagram in FIG. 2. Referring to that figure there is shown how the angular position of the control stick in pitch can vary with time t during a maneuver, e.g. during target tracking, with a relatively great and rapidly growing load factor. Since the steering signal emitted from the control stick is precisely responsive to this angular position the diagram also shows how the steering signal DP may vary with time. As appears from FIG. 2, it is typical of the steering performance that a change in the angular position and thereby the steering signal designated ΔDP in FIG. 2, is quickly followed by a correction ΔDP′ in the opposite direction, whereupon the stick turns again and a new short increase ΔDP″ occurs.

Tests have been made with a large number of pilots to provide survey data on individual differences in steering performance. It has been shown that the differences concern above all the amplitude of change in the stick corrections. Pilots with particularly well-developed sensitivity or fine motor ability make the smallest corrections while others operate the steering control with greater amplitudinal changes. On the other hand the differences between pilots are small with respect to the time interval between stick corrections, i.e., the time passing between two consecutive turning points in the steering signal function. In the part of the diagram in FIG. 2 referred to in the preceding paragraph Δt represents such a time interval.

Even if these time intervals are different between themselves, which can be explained by changes in the flight condition and in the task to be solved by the pilot, experience shows that normal steering performance is linked to a specific time pattern which is common for a large group of pilots. The time pattern for the pitch channel gives an average interval value of about 0.5 seconds with a few longer intervals up to about 1 second. In the roll channel, which is characterized by slower motions, the pattern shows that steering deflections have double the duration or about 1 second.

It is the knowledge of these time patterns and the understanding that the vehicle operator's steering activity mirrors the degree of consciousness that is the basis of the present invention. That is, according to the invention the steering signal from the steering control is controlled with respect to the time interval of the corrections and a prolonged time interval evidenced at this control is a symptom of a lowered degree of consciousness, which can be used to rescue the operator.

A monitoring system functioning in accordance herewith is generally designated by 11 in FIG. 4, wherein there is also shown in principle the aircraft control system 10 and indicator system 12. The steering signal DP emitted from the control stick 9 is preferably taken from the pitch channel 13 of the control system since this contains more information than the roll channel 14 and is therefore the most suitable for a time control. This signal is forwarded after sampling to a block 15 which gates the signal depending on whether or not certain conditions are fulfilled.

The conditions may concern existing flight conditions, which can be identified in a block 16 with the aid of data accessible in the control system and indicating the load factor (acceleration) and load factor gradient existing at the moment, the roll angle of the aircraft, the flight-path angle, height and speed, all being quantities indicating whether the flight condition is such as shall call for monitoring the pilot. In addition to being acted upon by the block 16, the on/off function in the block 15 can be acted upon by a manual control means 17, which the pilot can operate himself.

The sampled input signal DP is led from the block 15 to a block 18, which comprises logic circuits in which the processing of the invention is effected. The processing implies that it is possible from the signal to distinguish between steering deflections made in one direction, e.g., increasing control stick angle, and steering deflections in the opposite direction, decreasing control stick angle, so that through this every turning point in the steering process can be identified through the signal. The block 18 functions to effect time calculation and time signaling in such a manner that for each turning point, i.e., every time the signal DP indicates a new steering deflection, such as the steering deflection corresponding to ΔDP′ in FIG. 2, going in the opposite direction to that immediately preceding, here corresponding to ΔDP, it begins to produce a time dependent signal CPT. This then corresponds to the time passing from the moment when the new steering deflection is begun, i.e., the signal CPT gives a measure of the time interval Δt in FIG. 2.

The time dependent signal (CPT) will now be tested according to the characteristics of the invention for the purpose of controlling the control stick activity and thereby the pilot's consciousness. Primarily, the test is designed to show whether or not the signal CPT stays within predetermined time limit values.

To this end the system of the embodiment of FIG. 4 has additional logic circuits, shown as three blocks 19-21, which are connected parallel to block 18. Each block is programmed with conditions relating to the content of the received signal.

In the condition block 19 the signal from block 18 is compared with a reference value CPTR which constitutes a lower limit for the function of the indicator system 12 with regard to the control stick activity control. When the reference value is reached a signal appears in circuit 22, whereby the indicator function is initiated.

In the condition block 20 the time dependent signal CPT is compared with a first time limit value CPTW, which is chosen so as to include by a comfortable margin the longest time interval Δt occurring at a normal steering performance simultaneously with the value representing a limit, above which the steering performance can no longer be considered normal, but may be caused by a lowered degree of consciousness. If CPT reaches the value CPTW a warning is given to the pilot.

A signal WARNING ON will then appear in circuit 23 as soon as said conditions are fulfilled.

In the condition block 21 the time dependent signal CPT is compared with a second time limit value CPTA, which is higher than CPTW and shall be regarded as a definitive limit for normal steering performance, i.e., the limit at which the pilot's consciousness can be considered heavily lowered or momentarily lost. The pilot is here no longer considered capable of controlling his aircraft. In accordance with the invention, if CPT reaches the value CPTA, a switching is effected in the control system 10 such that the aircraft, in an automatic steering mode, without the pilot's assistance, is taken out of its critical position. This is initiated by the signal AUTO-STEERING MODE ON in circuit 24 as soon as said conditions are established. In that phase of activity the signal function DP(t) may have the appearances which are shown in the upper and lower diagrams in FIG. 3.

After a phase a with normal steering performance characterized by close, consecutive control stick corrections, a control stick displacement b follows extending over a considerably longer time interval and indicates a change in the steering performance. Simultaneously with the time interval reaching the above said first limit value, i.e., when the time calculating circuit in the block 18 has calculated the time for the control stick displacements in question to the value CPTW, the warning signal is set on, which is indicated by the symbol V in FIG. 3. If the pilot now responds to the warning and immediately begins to steer with normal short control stick corrections whose time intervals are below the limit CPTW, phase c in the upper diagram, the monitoring system 11 returns to the starting position, whereupon the signal WARNING OFF goes out in circuit 23 from the condition block 20.

Should, however, the pilot's passivity continue past the point V, which can result assumably in a control stick displacement d without his assistance, see the lower diagram of FIG. 3, the time dependent signal CPT will continue to grow. When comparison in block 21 with the second time value CPTA shows that this value has been reached and the condition for the auto-steering mode is thus created, the signal AUTO-STEERING MODE ON is emitted, which in the diagram is indicated by A. Simultaneously, an automatic rescuing maneuver begins, preferably an ascension to high altitude followed by horizontal flight. During such flight condition the pilot can be expected to regain consciousness and become capable of resuming the steering. As soon as normal steering performance with short control stick corrections returns, the auto-steering mode is inhibited by the signal AUTO-STEERING MODE OFF in circuit 24. The signal can, however, remain the whole time in circuit 22.

Figure 6A:
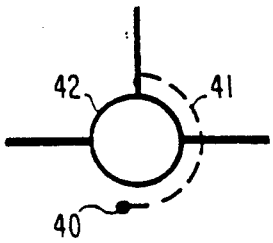
FIG. 6A, 6B and 6C illustrates examples of indicating symbols that may be used to warn the pilot.
Figure 6B:
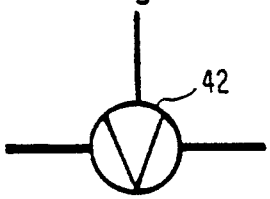
Figure 6C:
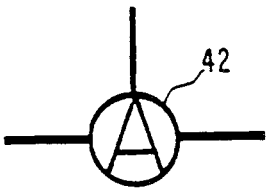

The indications produced by the indicator system 12 on command from monitoring system 11 may be arranged as illustrated by FIGS. 6 and 1. In FIG. 6 to the left, 40 is a luminous dot moving in a circular path 41, so located on the aircraft instruments that the pilot can easily observe the dot. The dot is preferably projected on screen 8 and display units 4 and 6 on the spots where the aircraft symbol 42 is located. Through its movements the dot represents the control stick corrections in such a manner that for each turning point it hops back to a given starting position, which in FIG. 4 is the vertical line in symbol 42. Because of the angular speed of the dot being constant the ending position for every control stick correction will be a measure of its duration, i.e., responsive to the value CPT of the time dependent signal, and if the angular speed is so chosen the dot 40 at normal CPT values moves less than one revolution, the pilot will be able to see from the dot's ending position if the time of the control stick corrections is normally short or tends to reach a limit involving danger of G-LOC. A graduation along path 41 such as increasing luminous intensity of the dot may be used to facilitate this observation.

The center illustration of FIG. 6 illustrates the visual information to the pilot after phase b in FIG. 3, i.e., when the time of the control stick corrections has reached the limit value CPTW. In the center of symbol 42 it is now shown, instead of the dot 40, the sign V which is the result of the indicator system 12 having received the warning signal from monitoring system 11. The sign can be given in a strongly luminous color, alternatively with twinkling light, and to further emphasize the warning this visual information can be combined with an audible signal in the head phone contained in the pilot's helmet 3.

In the right illustration in FIG. 6 it is shown how signal V in symbol 42, in case the pilot does not respond with normal control stick activity, is replaced by an A representing auto-steering mode and appearing after phase d in FIG. 3 when the time from the last turning point has reached the second time limit value CPTA.

From what has been said above it is obvious that the described system is capable of indicating a low control stick activity, expressed as the exceeding of the time value for a control stick correction, as the exceeding occurs. The indication of the low control stick activity and thereby of the symptoms of a lowered degree of consciousness, therefore, requires no time beyond this time measure. In comparison with earlier proposed systems, which imply physiological measurements on the pilot or a frequency analysis of the control stick movements, the reaction time of the system according to the invention is considerably shorter. Every unnecessary waste of time from the critical moment when the symptoms first occur until counter measures are taken means that the serious situation which the pilot is experiencing deteriorates further. The quicker action made possible by the invention greatly improves the possibility of warning or rescuing a pilot to whom G-LOC or other similar effects have occurred.

Figure 5:
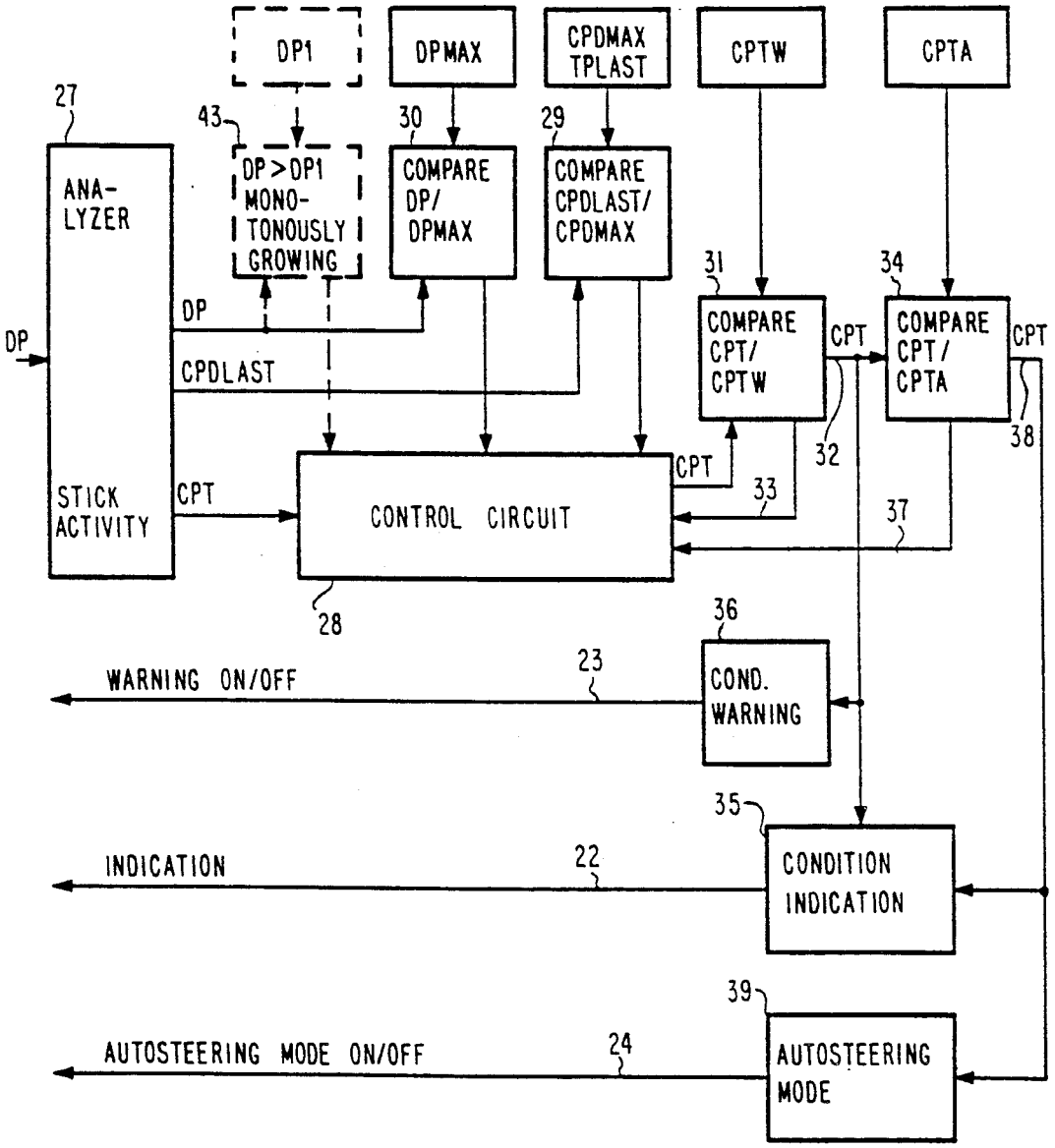

A monitoring system according to the invention, which is more detailed and developed than the one designated by 11 in FIG. 4, is shown in FIG. 5. The input signal is as before, the steering signal DP corresponding to the angular position of the control stick. In a first block 27, which has calculating and memory functions, the time dependent signal CPT is produced continuously, with the aid of the input signal and a clock pulse signal, said time dependent signal having the same characteristics as described above, and here being led to a control circuit 28. Furthermore, in block 27 the amplitude gradient is determined for the last effected control stick correction. The amplitude gradient is represented by the amplitude CPDLAST during a short, predetermined time value TPLAST within the same correction. The signal value CPDLAST is transmitted to a first amplitude comparing means 29.

A second amplitude comparing means 30 received on its first input the steering signal DP and on its second input the initial value DPMAX, which designates the steering signal that corresponds to the maximum steering deflection angle of the control stick, which can have different values in the positive and negative direction from the neutral position.

If it is now at first assumed that the steering signal is smaller than DPMAX which the comparing means 30 informs to the control circuit 28, and that CPDLAST for the last measured and compared (in block 29) control stick correction does not exceed the maximum value CPDMAX within the time TPLAST, this shows that this control stick correction is normal with regard to the amplitude and its time derivative. Under such conditions the time dependent signal CPT will go unchanged from the control circuit 28 to a first time comparing means 31. On the second input of this comparing means is the value CPTW, which defines in the same way as in the system variant in FIG. 4 a first time limit value predetermined for warning. This value is preferably adjustable so that the system can be given flexibility and permit adjustment according to the pilots' individual differences with respect to tolerance towards load factor and load factor growth. It is also possible to make the CPTW value flight condition dependent.

On the comparison in block 31 it is established whether the value of the CPT signal reaches or exceeds CPTW. The result is fed back to the control circuit 28 via a connection 33. The CPT signal on the output 32 of the comparing means 31 passes on to three blocks, namely a second time comparing means 34 and first and second condition blocks 35 and 36, respectively. In the second time comparing means 34 it is established whether the value of the CPT signal reaches or exceeds a second programmed time limit value CPTA, which constitutes a condition for the switching of the aircraft control system to auto-steering mode. The result of the comparison is fed back to the control circuit 28 via a connection 37.

In the first condition block 35 a control is effected in response to whether criteria for actuation of the indicator function of the monitoring system is fulfilled. When such is the case as in the system in FIG. 4, circuit 22 transmits a signal.

In the second condition block 36 a control is effected through the CPT signal as to whether the condition CPT $\geqq$ CPTW and other warning criteria (see below) are fulfilled. If that is the case the WARNING ON signal is emitted via circuit 23 as before.

The CPT signal on output 38 from block 34 is forwarded to a third condition block 39. By analogy with what has just been described the signal AUTO-STEERING MODE ON is emitted therefrom in circuit 24 if the condition CPT $\geqq$ CPTA and other conditions (see below) are fulfilled.

The measures initiated in this manner by the monitoring system on an established abnormal steering performance are not interrupted until the steering performance has returned to normal, by which is meant that the control stick corrections are beginning to come so closely that the CPT value is below said time limit value CPTW. In order that the system shall be capable of establishing that this condition is fulfilled it requires that the signal DP emitted from the control stick once again shows two or more consecutive turning points delimiting one or more control stick corrections within such a short time interval.

As soon as the time comparing means 31 senses this short time interval, it operates through connection 33 to the control circuit 28 to insure that the control circuit is switched so that the CPT signal is assigned the value zero. This has the consequence that the signal from block 34 via output 38 which initiated the auto-steering mode, or alternatively the signal from block 31 if there has been a warning only, is immediately inhibited. The result is that the monitoring system returns to the AUTO-STEERING MODE OFF and WARNING OFF conditions, respectively. By this action of the system the situation for the pilot and the aircraft has quickly become normal again and the system has resumed its usual monitoring of the pilot's steering performance.

The course just described with reference to FIGS. 4 and 5 of the on and off switching of warning and auto-steering mode is to be considered the primary function of the monitoring system based purely on time control of the control stick corrections. In order to respond also to other changes in steering performance symptomatic of a lowered or lost consciousness, the monitoring system according to FIG. 5 may suitably incorporate in addition to the primary function the following additional functions regarding the criteria for warning and auto-steering mode.

Abandoning the assumption above that the steering signal DP is smaller than DPMAX, i.e., the value stored in the amplitude comparing means 30, and assuming instead that DPMAX is exceeded, the control circuit 28 receives information from the comparing means indicating such condition. According to an algorithm included in the control circuit, the time dependent signal CPT coming from the circuit is assigned the value CPTW, unless the value of the signal due to a control stick movement has already exceeded this limit value. Consequently, the signal value CPTW goes out on output 32 of time comparing means 31, which means that the condition for WARNING ON has been fulfilled.

If the value of the CPT signal through continued upwards adjustment in block 27 should exceed the value CPTW, which has been assigned to the signal from circuit 28, and reach the second time limit value CPTA, then condition block 39 brings about, in the same manner as described above for the primary function of the system, that the AUTO-STEERING MODE ON signal is emitted. Signals for the off-switching of the auto-steering mode and/or the warning are emitted according to the same rules as mentioned above, i.e., one or more normal control stick corrections are required with turning point positions that give DP $<$ DPMAX and with a duration CPT $<$ CPTW. If this off-switching condition is not fulfilled the on-switching is maintained, whereupon upwards adjustment of the present CPT value will continue.

The additional function just described comprehends that the monitoring system reacts to abnormal steering performance of panic-like or spastic control stick corrections of extremely great amplitude, which is a known symptom of high acceleration strain.

Control stick corrections of a similar kind but executed with extreme quickness may also occur, and with conditions combined in a particular manner in the circuits that process the control signal such symptoms can also be interpreted as abnormal steering performance.

Such a combination of conditions can relate to the value CPDLAST, i.e., the amplitude during the short predetermined time value. TPLAST within the latest control stick correction in relation to the predetermined maximum value CPDMAX, whereby CPDLAST and TPLAST together represent the time derivative of the signal function. If calculation in the comparing means 29 shows that CPDLAST ≧ CPDMAX, the system will interpret this as an abnormal control stick correction, and the signal from the comparing means to the control circuit 28 leads to the time dependent signal CPT on the control circuit output being assigned instantaneously the time limit value applicable to warning CPTW, unless the value of the signal due to a slow control stick correction has already exceeded this time limit value.

The signal WARNING ON is now emitted, and in case a new control stick correction in the opposite direction is not detected immediately, the signal AUTO-STEERING MODE ON will follow as soon as the progressed CPTW value has been adjusted upwards to the time limit value CPTA.

When the above mentioned combination of conditions is no longer fulfilled and one or more normal control stick corrections are effected according to the definition of the preceding additional function, the inhibiting information is transmitted in connections 24 and/or 23 so that the control and indicator systems 10 and 12 regain the function for normal flight.

In addition to the above described additional functions which relate to the abnormal steering performances that are characterized in that DP ≧ DPMAX in the first case and in that CPDLAST ≧ CPDMAX during the time period TPLAST in the second case, the monitoring system can be given a still additional function which relates to a particular normal steering performance for which activation of the warning signal and/or of the switching to the auto-steering mode is not desired. The case intended here with such normal steering performance is the case when the pilot, from a control stick deflection which exceeds a predetermined control stick deflection in the direction in which the control stick movement increases, executes a monotonously progressing increase of the control stick deflection in said direction, where the increase occurs so slowly that the activation of the warning signal and/or of the switching to the auto-steering mode would normally occur. However, since the control stick moment increases gradually during the described control stick movement and a certain muscular effort is thereby required of the pilot, he would perform the steering while being fully conscious.

The last mentioned additional function is illustrated in FIG. 5 with broken lines. In block 43, which is provided with a predetermined steering signal value DP1 corresponding to the above mentioned predetermined control stick deflection, it is detected whether the steering signal DP is monotonously growing and larger than DP1, assuming here that the direction in which the control stick moment increases corresponds to growing steering signal DP. If the steering signal DP is monotonously growing and DP > DP1, block 43 acts via a connection to control circuit 28 so that this is switched in such a manner that the CPT signal at the circuit output is assigned the value zero. This creates a condition wherein no activation of the warning signal and/or switching to the auto-steering mode occurs unless the steering signal DP reaches the value DPMAX or CPDLAST reaches the value CPDMAX during the time period TPLAST.

The invention may be embodied in other specific forms without departing from the spirit or essential characteristics thereto. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A method of monitoring in the control system of an aircraft the steering performance of the aircraft operator, wherein the system comprises a steering control (9) which is maneuvered by the operator when steering the aircraft through steering deflections in two opposite directions, whereby a steering signal (DP) indicating the size and direction of the steering deflections is produced; such method comprising an analysis of the deflections to detect an abnormal steering performance, in order that if the analysis shows an abnormal steering performance, in order that if the caused by a lowered degree of operator consciousness, the system is caused to activate means to initiate action to cause a switch to an automatic steering mode in which the operator's assistance is not required, characterized in that a time dependent signal (CPT) is produced every time that the steering signal (DP) indicates that a new steering deflection is effected in the opposite direction to that immediately preceding, which time dependent signal (CPT) corresponds to the time elapsing in the intervals commencing from the moment when the new steering deflections are begun, and further characterized in that the value of the time dependent signal is compared continuously with at least one predetermined time limit value (CPTW, CPTA), the reaching of which constitutes a condition for the activation of said means to initiate the switching to the automatic steering mode.

2. A method according to claim 1 characterized in that the value of the time dependent signal (CPT) is first compared with a first predetermined time limit value (CPTW), the reaching of which constitutes a condition for the activation of a warning signal, and in that the value of the time dependent signal thereupon is compared with a higher second predetermined time limit value (CPTA), the reaching of which constitutes a condition for automatic activation of switching to the automatic steering mode.

3. A method according to claim 2 characterized in that a first predetermined time limit value (CPTW) is so determined that it includes the longest time interval for a predetermined steering deflection occurring at a normal steering performance.

4. A method according to claim 2 characterized in the warning signal is released if the steering signal (DP) reaches a value (DPMAX) corresponding to the highest permitted steering control deflection and that the switching to the automatic steering mode is initiated thereupon if the value of the time dependent signal (CPT) reaches the second predetermined time limit value (CPTA).

5. A method according to claim 4 characterized in that the time dependent signal (CPT) is given the first predetermined time limit value (CPTW) as soon as the steering signal (DP) reaches the value (DPMAX) corresponding to the highest permitted steering deflection of the steering control (9).

6. A method according to claim 2 characterized in that the time dependent signal is released if the steering signal (DP) reaches a predetermined, high amplitudinal value (CPDMAX) within a time interval (TPLAST), which is shorter than the first predetermined time limit value (CPTW), and in that the switching to the automatic steering mode is initiated thereupon if the value of the time dependent signal (CPT) reaches the second predetermined time limit value (CPTA).

7. A method according to claim 6 characterized in that the time dependent signal (CPT) is given the first predetermined value (CPTW) as soon as the steering signal (DP) reaches said amplitudinal value (CPDMAX) within said time interval (TPLAST.

8. A method according to claim 1 characterized in that said means to initiate is switched off when the time dependent signal (CPT) shows that after its activation normal steering deflections again follow and the signal CPT no longer exceeds the predetermined time limit value CPTW.

9. A method according to claims 4 or 6 characterized in that activation of said means to initiate is prevented if the absolute value (DP) of the steering signal is larger than a predetermined value (DP1) but smaller than the value (DPMAX) which corresponds to the highest permitted steering deflection of the steering control (9) simultaneously with the steering signal (DP) being changed monotonously in a direction corresponding to increasing steering control moment, without reaching said amplitudinal value (CPDMAX) within said time interval (TPLAST).

10. A method according to claim 1 characterized in that activation of said means to initiate occurs only if an additional condition determined by the existing flight condition if fulfilled, wherein said additional condition comprises the existence of a predetermined value of at least one of flight level, speed, load factor, roll angle and flight path angle.

11. A device in the control system of an aircraft for monitoring the aircraft operator's steering performance, which system comprises a steering control (9), which can be maneuvered by the aircraft operator through steering deflections in two opposite directions and is arranged to produce a steering signal (DP) which indicates the size and direction of the steering deflections, and means to perform an analysis of the steering deflections and if the analysis shows a departure from a predetermined normal steering performance, which may be caused by a lowered degree of operator's consciousness, to activate means to initiate action to cause switching to an automatic steering mode wherein operator assistance is not required, characterized in that said means comprise a time calculator means (18, 27), to which the steering signal (DP) is fed, and which is so arranged that every time the steering signal indicates that a new steering deflection is effected in the opposite direction to that immediately preceding, it emits a time dependent signal (CPT), the value of which corresponds to the time passing from the moment when the new steering deflection is started, and comparing means (20, 21; 31, 34) arranged to compare the value of the time dependent signal with at least one predetermined time limit value (CPTW, CPTA), the reaching of which constitutes a condition for the activation of switching to said means to initiate automatic steering mode.

12. A device according to claim 11 characterized in that said comparing means comprises a first circuit (20; 31), connected between the time calculator means (18; 27) and an indicator (12, 4, 6, 8) which can be observed by the vehicle operator, said first circuit being arranged to compare the value of the time dependent signal (CPT) with a first predetermined time limit value (CPTW) and to cause the indicator to emit a warning signal when the first predetermined time limit value is reached.

13. A device according to claim 12 characterized in that said comparing means comprises a second circuit (21; 34) connected between the time calculator means (18; 27) and an executing means in the control system (10), this second circuit being arranged to compare the value of the time dependent signal (CPT) with a second predetermined time limit value (CPTA), which is higher than the first predetermined time limit value (CPTW), and to cause the executing means to perform switching to an automatic steering mode when the second predetermined time limit value is reached.

14. A device according to claim 13 characterized in that for interaction with said comparing means there is provided a third circuit (19) connected parallel to the first circuit (20) and arranged to compare the value of the time dependent signal (CPT) with a time threshold value (CPTR), which is lower than the first predetermined time limit value (CPTW) to activate the indicator (12) when the value of the time dependent signal (CPT) for every steering deflection reaches the time threshold value (CPTR).

15. A device according to claim 11 characterized in that said comparing means (20, 21; 31, 34) are arranged to deactivate said means to initiate, when a comparison by said comparison means indicates that steering performance no longer departs from said predetermined norm.

16. A device according to claim 11 disposed in an aircraft, characterized by control means (28) receiving input data determined by a flight parameter wherein said parameter comprises at least one of flight level, speed, load factor, roll angle flight path angle, and said control means preventing activation of said means to initiate so long as the flight parameter data input to said control means does not satisfy a predetermined value condition.

17. A method according to claim 1 wherein said means to initiate comprises a warning signal.

18. A method according to claim 1 wherein said means to initiate comprises automatic steering means.

19. A device according to claim 11 wherein said means to initiate comprises warning signal means.

20. A device according to claim 11 wherein said means to initiate comprises automatic steering means.

* * * * *